US007121963B2

(12) United States Patent
Corbin et al.

(10) Patent No.: US 7,121,963 B2
(45) Date of Patent: Oct. 17, 2006

(54) YARD GAME OBSTACLE SYSTEM

(76) Inventors: Steve Corbin, 8820 NE. 102nd St., Vancouver, WA (US) 98662; Margie Corbin, 8820 NE. 102nd St., Vancouver, WA (US) 98662

( * ) Notice: Subject to any disclaimer, the term of this patent is extended or adjusted under 35 U.S.C. 154(b) by 0 days.

(21) Appl. No.: 10/753,836

(22) Filed: Jan. 5, 2004

(65) Prior Publication Data

US 2005/0148411 A1 Jul. 7, 2005

(51) Int. Cl.
*A63B 67/00* (2006.01)
*A63B 67/02* (2006.01)

(52) U.S. Cl. ..... 473/410; 473/156

(58) Field of Classification Search ..... 473/157–159, 473/162–164, 170, 173, 174, 185, 180, 181, 473/410, 411; 446/168
See application file for complete search history.

(56) References Cited

U.S. PATENT DOCUMENTS

| | | | | | |
|---|---|---|---|---|---|
| 95,969 | A | | 10/1869 | Barlow | |
| 143,047 | A | | 9/1873 | West et al. | |
| 172,685 | A | * | 1/1876 | Angell | 473/411 |
| 721,544 | A | * | 2/1903 | Crandall | 473/109 |
| 810,853 | A | | 1/1906 | Griswold | |
| 841,936 | A | | 1/1907 | Cole | |
| 1,152,313 | A | | 8/1915 | Hammond et al. | |
| 1,522,228 | A | | 1/1925 | Carlson | |
| 1,545,329 | A | * | 7/1925 | Johnston, Jr. | 473/185 |
| 1,583,244 | A | | 5/1926 | Burris et al. | |
| 1,583,250 | A | | 5/1926 | Heath et al. | |
| 1,783,089 | A | * | 11/1930 | Hokin | 473/185 |
| D83,050 | S | * | 1/1931 | Lagaard | D21/319 |
| D83,501 | S | * | 3/1931 | Carter | D21/319 |
| 1,870,536 | A | * | 8/1932 | Vaccaro, Jr. | 473/158 |
| 2,019,302 | A | | 10/1935 | Gibson | |
| 2,157,023 | A | * | 5/1939 | Shannon | 273/118 R |
| 2,456,322 | A | * | 12/1948 | Richardson | 473/185 |
| 2,801,854 | A | | 8/1957 | Trudeau | |
| 2,974,958 | A | * | 3/1961 | O'Herron | 473/158 |
| 3,084,941 | A | | 4/1963 | Anthony | |
| 3,135,514 | A | | 6/1964 | Ahrent | |
| 3,356,370 | A | * | 12/1967 | Larsen | 473/172 |
| 3,464,697 | A | | 9/1969 | Robillard, Jr. | |
| 3,659,856 | A | * | 5/1972 | Fatur | 473/180 |
| 4,957,290 | A | | 9/1990 | Major et al. | |
| 5,201,519 | A | | 4/1993 | Sorteberg | |
| 5,516,108 | A | | 5/1996 | Foster et al. | |
| 5,580,319 | A | | 12/1996 | Hamilton | |
| 6,599,164 | B1 | * | 7/2003 | Gerwitz et al. | 446/168 |

* cited by examiner

*Primary Examiner*—Mark S Graham
(74) *Attorney, Agent, or Firm*—Marger Johnson & McCollom, PC

(57) ABSTRACT

Embodiments of the invention are directed to obstacles for used in yard games, a set of obstacles, and a method of playing games using the obstacles. Example obstacles include a ramp, a helical loop, a banked curve, and an inclined pipe. Although preferably these obstacles are used in croquet, some or all of them can be used in other yard games, such as yard bowling (bocce), rolling hoops, etc., or variations thereof.

11 Claims, 8 Drawing Sheets

YARD GAME OBSTACLE SYSTEM

TECHNICAL FIELD

This disclosure relates to a system for playing a game and, more particularly, to a new system for playing a yard game using alternatives to traditional obstacles.

BACKGROUND

Yard games, such as croquet, are well known. The game of croquet has been played for decades. Early croquet games typically included wooden mallets, wooden balls, metal-wire wickets, and wooden stakes. Newer games have some of the pieces made out of plastic.

In a standard croquet game, wickets are set within a playing field in a standard configuration. A player progresses his or her ball through all the wickets (typically 6, 7, or 9), toward a turning stake, which is located at the far side of the field. A player gets an extra turn for causing their croquet ball to pass through a wicket. After striking the turning stake with the ball, the player returns through the wickets to the finishing stake. The first to strike the finishing stake is the winner.

If a first player's ball strikes another player's ball during the first player's turn (a croquet), the first player is allowed to knock the other player's ball by resting their ball next to the other player's ball, holding their own ball under their foot, and striking their ball so as to send the second player's ball rolling far away.

Although the game of croquet is highly entertaining, playing the same game, even with variation, can get repetitive and cause players to become disinterested.

Embodiments of the invention address these and other limitations in the prior art.

DETAILED DESCRIPTION

Embodiments of the invention are directed to obstacles for used in yard games. Although preferably these obstacles are used in croquet, they can be used in other yard games, such as yard bowling (bocce), rolling hoops, etc. Typically these yard games are played on a grass surface.

Figure 1:
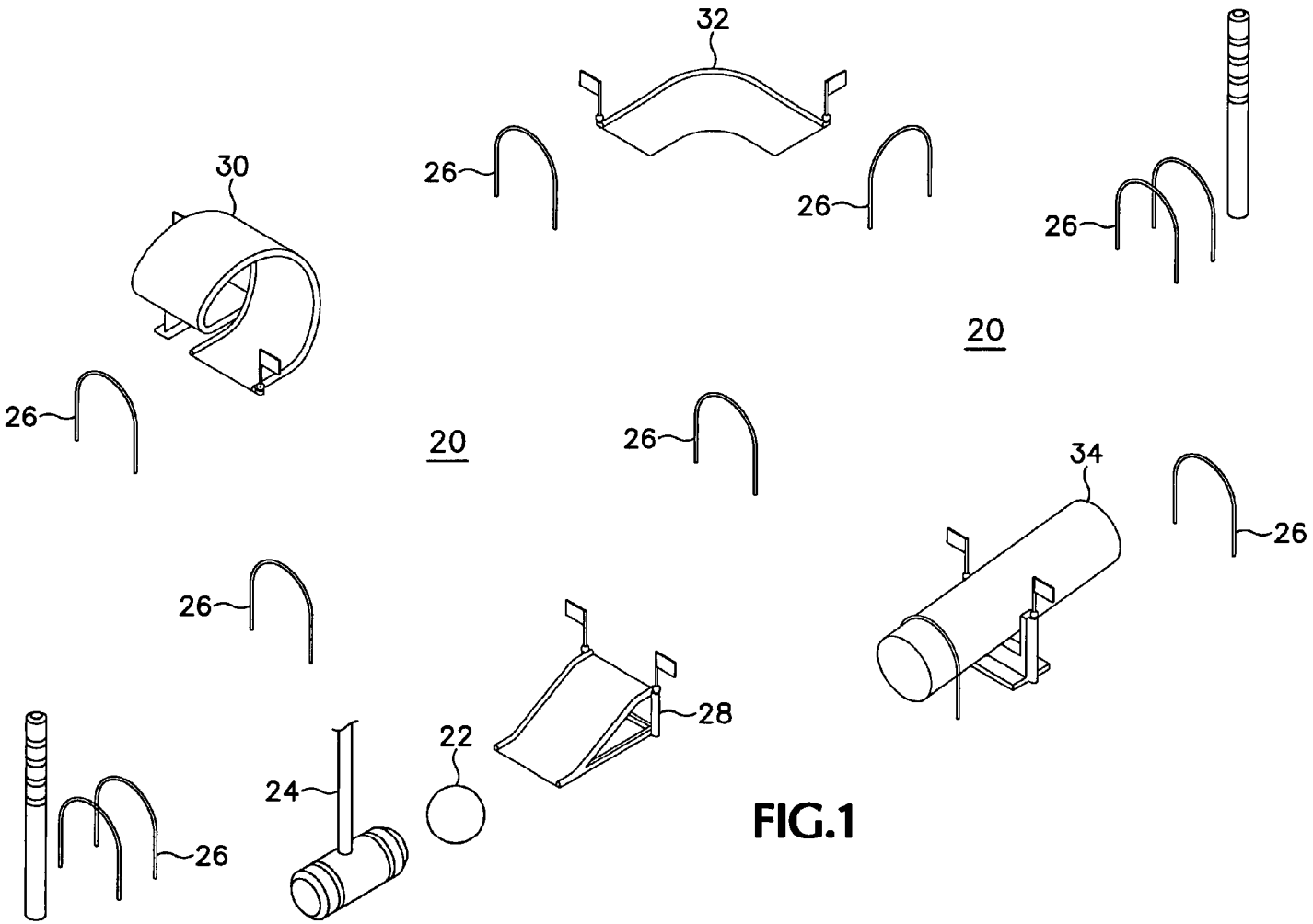
FIG. 1 is a perspective view of a croquet playing field showing wickets and obstacles according to embodiments of the invention.

Referring to FIG. 1, a perspective view of a croquet playing field 20 is shown. Players strike a ball 22 with a mallet 24 to send the ball through various wickets 26 and obstacles. The obstacles illustrated in FIG. 1 include a ramp 28, a helical loop 30, a banked corner 32, and a vertically inclined pipe 34. Players can arrange the wickets 26 and the obstacles in any manner that they choose, although sample positions can be suggested. The obstacles may be temporarily affixed to the playing field with stakes 36.

FIG. 1 shows the wickets and obstacles arranged in a manner that would allow players to cause their ball to pass over or though an obstacle, such as the ramp obstacle 28, in an effort to complete the game. In some games, after passing the ball through an obstacle, the player would then return the ball to a particular position on the playing field. For instance, the player could first send their ball over the ramp 28, and then be granted an extra stroke. Depending on the particular rules of the particular game, the player could then pass through a traditional wicket or series of wickets before again passing through another obstacle. A sample set of rules is included below.

Figure 2A:
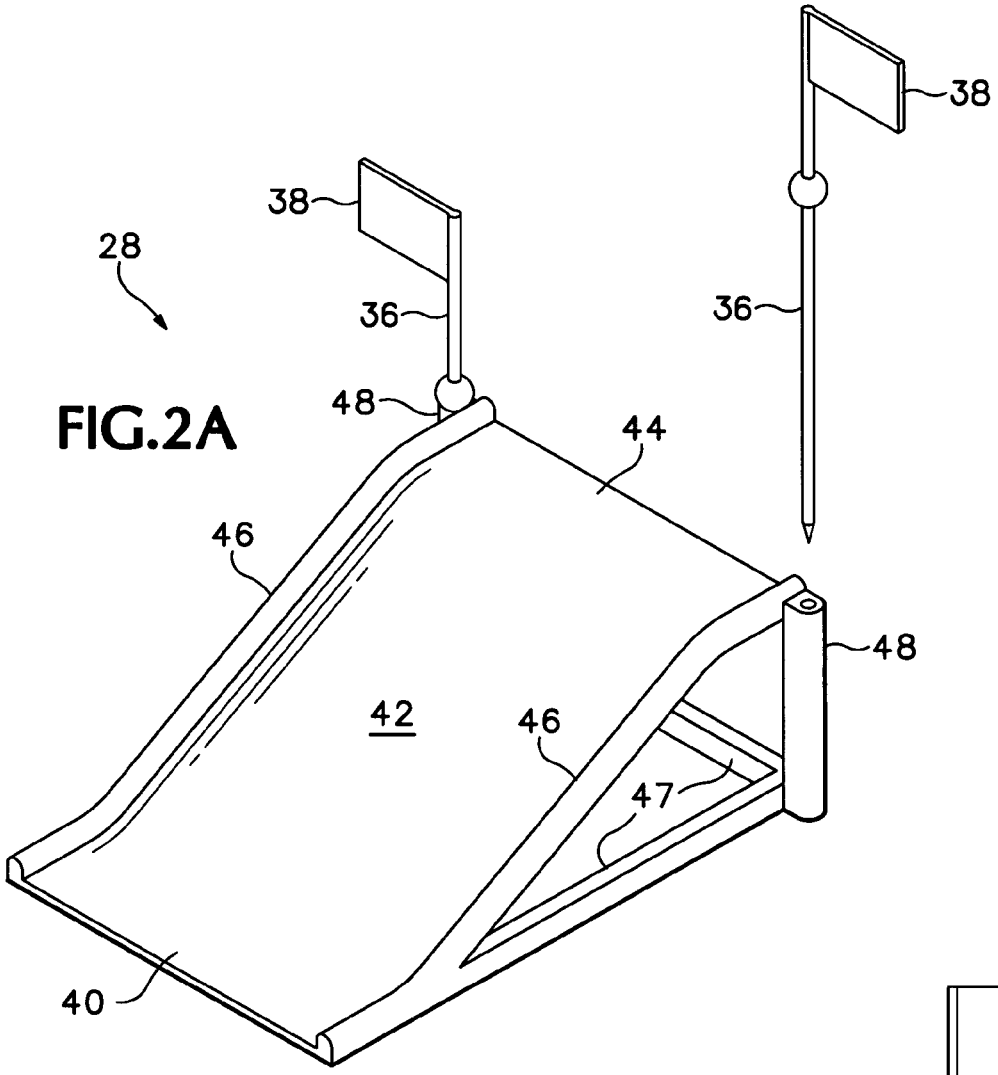
FIG. 2A is an isometric view of a ramp obstacle according to an embodiment of the invention.
Figure 2B:
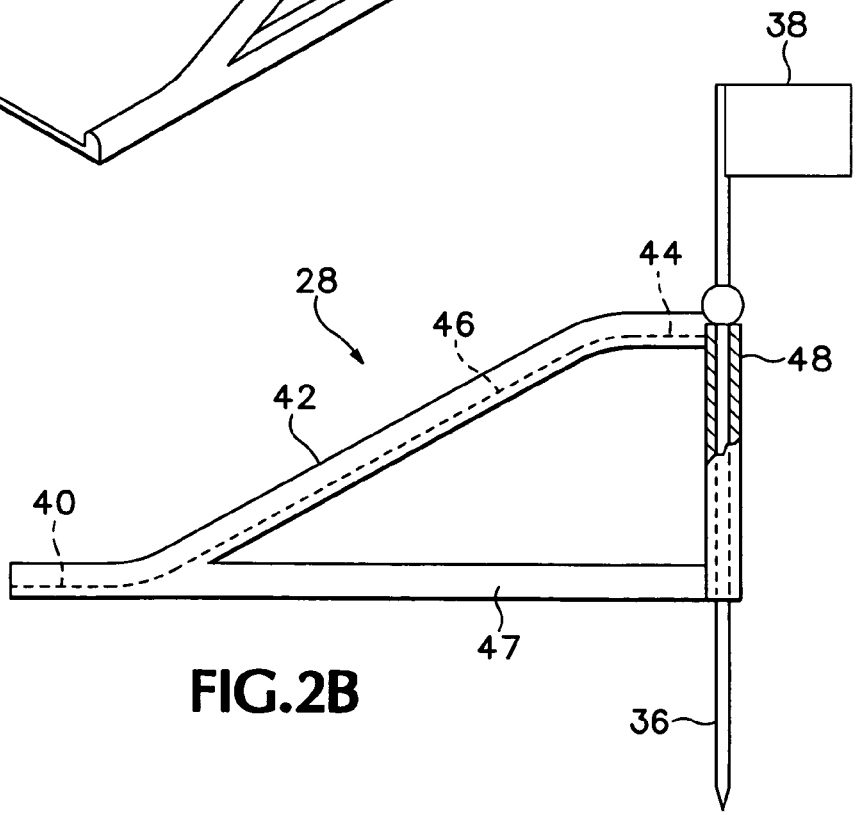
FIG. 2B is a side elevation view of the ramp obstacle of FIG. 2A having a partial cut away showing a method of securing the ramp to the playing field, according to an embodiment of the invention.

Referring to FIGS. 2A and 2B, a ramp obstacle 28 is shown, which can be used on the playing field 20 of FIG. 1. In FIGS. 2A and 2B, the ramp 28 has a substantially horizontal entry portion 40, a substantially horizontal exit portion 44, and an upwardly angled ramp portion 42 connecting the two horizontal portions 40, 44. Of course, other ramp shapes and slopes could be made.

Typically, the exit portion 44 is higher than the entry portion 40, although declined ramps are possible, for example, to match the topography of the playing field surface. The ramp 28 may include sidewalls 46, which are positioned to act as guides for keeping the ball (not shown) on the ramp 28 as the ball rolls on the ramp. The sidewalls may be larger, or smaller, or differently shaped than those illustrated in FIGS. 2A and 2B.

The ramp 28 may be made from any suitable material, such as plastic, molded plastic, metal, wood, wire, or any combination thereof.

Framing members 47 provide structure and stability to the ramp 28. The length of the framing members 47 determines the vertical distance and the horizontal distance of the ramp, which also determines the slope of the ramp 28. The framing members 47 are illustrated in FIGS. 2A and 2B as being frame-like rods or bars, but could be any shape able to give the ramp structure of appropriate durability and strength. For instance, the entire ramp 28 could be molded out of sheets of plastic, where the frame members 27 are not separated from the sidewalls 26 or other portions of the ramp.

In playing, a player strikes his or her ball 22 so that it rolls up the ramp 28. If the player strikes the ball 22 hard enough, the ball will be forcefully ejected from the top of the ramp 28 and land some distance from the ramp. If the player does not strike the ball 22 very hard, the ball may travel up and over the ramp 28 and land very close to the exit portion 44 of the ramp, which may make the next shot difficult to hit, because the preferred path of the mallet 24 to make the next shot may be impeded by the ramp 28. Similarly, if the player does not strike their ball 22 hard enough, the ball could travel some distance up the ramp 28, then return down the ramp due to gravity. This could also make the ball 22 difficult to hit for the next shot. Additionally, in some variations of the game, a player could be penalized for attempting to hit their ball through an obstacle, such as the ramp 28, and not completing the attempt.

Figure 2C:
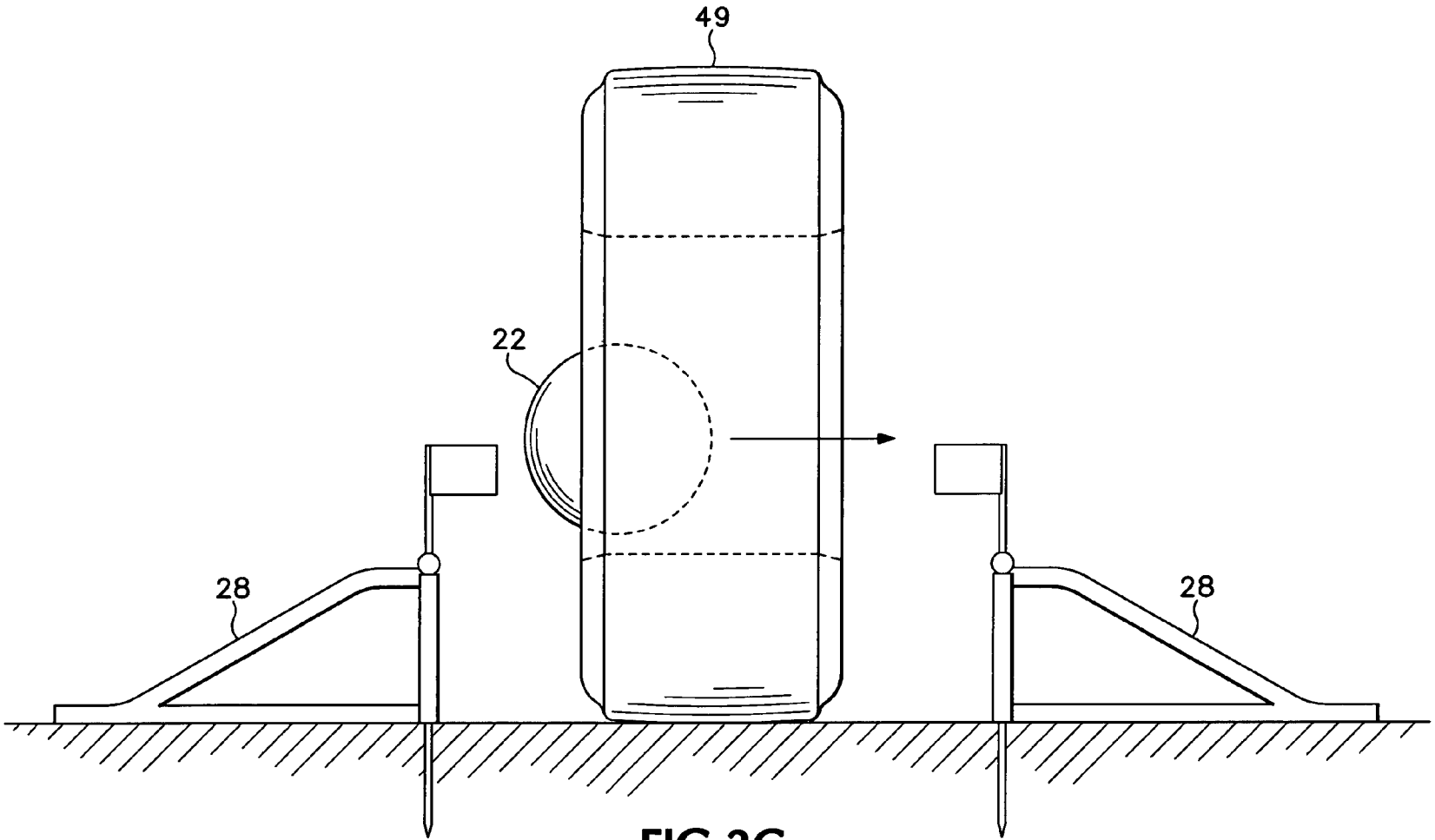
FIG. 2C is a side elevation view of two ramp obstacles of FIG. 2A arranged with another obstacle.

As illustrated in FIG. 2C, in some embodiments of the invention, multiple ramps 28 can be used in conjunction to make an especially difficult obstacle. For example, two ramps could be placed "end-to-end", so that the exit portions 44 of both of the ramps are facing each other. The rules could dictate the player to not only strike his or her ball 22 so that it rolls up the first ramp 28, but require that the ball 22 roll down the second ramp to get "credit" for having passed the obstacle. The ramps 28 could be directly adjacent to one another, such that the ball 22 need only be lightly struck to roll up a first ramp 28 and down another. Or, the ramps 28 could be placed relatively far apart, which forces the player to adjust the swing speed of the mallet 24 used to strike the ball 22 to ensure that the ball will touch both of the ramps.

Other obstacles could be placed near the exit end 44 of the ramp 28 or between two ramps 28 that are facing each other. FIG. 2C illustrates such an obstacle 49. In FIG. 2C, two ramps 28 are facing each other and the obstacle 49 is located between the ramps. This particular obstacle 49 has a hole formed through it and could be embodied by a tire, for instance. During gameplay, a player strikes the ball 22 to cause it to travel up the first ramp 28 and hopefully through the hole in the obstacle 49 before traveling down the second ramp 28. If the ball 22 does not travel through the hole in the obstacle 49, a penalty can be levied, or a player could lose his or her turn, or other outcomes are possible. The obstacle 49 may be placed near the exit portion 44 of a single ramp 28 rather than being placed between two ramps as shown in FIG. 2C.

The ramp 28 may be affixed to a playing field 20 with stakes 36 to prevent the ramp from moving. For instance, the stakes 36 may pass through eyelets 48 positioned near corners of the ramp 28. The eyelets 48 hold the stakes 36 in place. In FIG. 2A, only a single pair of eyelets 48 are shown, but any number of eyelets could be present. The eyelets could be any appropriate shape and size, such as a cylindrical tunnel running down the side of a ramp 28. To secure the ramp 28 to the playing field 20, end portions of the stakes 36 are passed through the eyelets 48 and into the ground. As shown in FIG. 2B, each stake 36 may include a projection or bulge that is shaped to fit in a cup or other holder at the top of the eyelet 48. For instance, a stake 36 could have a spherical bulge 37 formed part way up the stake that is larger in diameter than a diameter of the eyelet 48. When the bulge portion 37 of the stake 36 meets the eyelet 48 and the stake is further pressed into the playing field 20, the bulge portion 37 pushes down on the eyelet 48 to secure the ramp 28 to the playing field 20. Of course, other shapes of the stake 36 and eyelet 48, or even other mechanisms for attaching the stakes to the ramp 28, such as clips or other receivers, could be used without deviating from the inventive spirit of the invention.

Figure 3A:
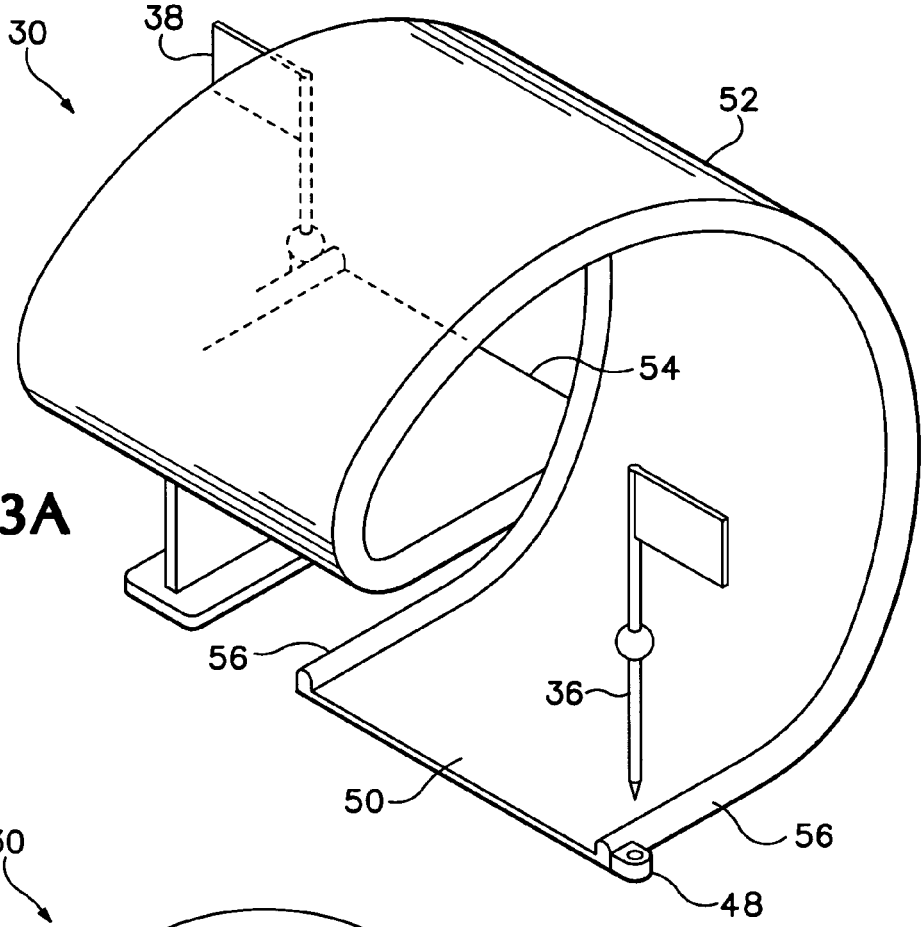
FIG. 3A is an isometric view of a loop obstacle according to another embodiment of the invention.
Figure 3B:
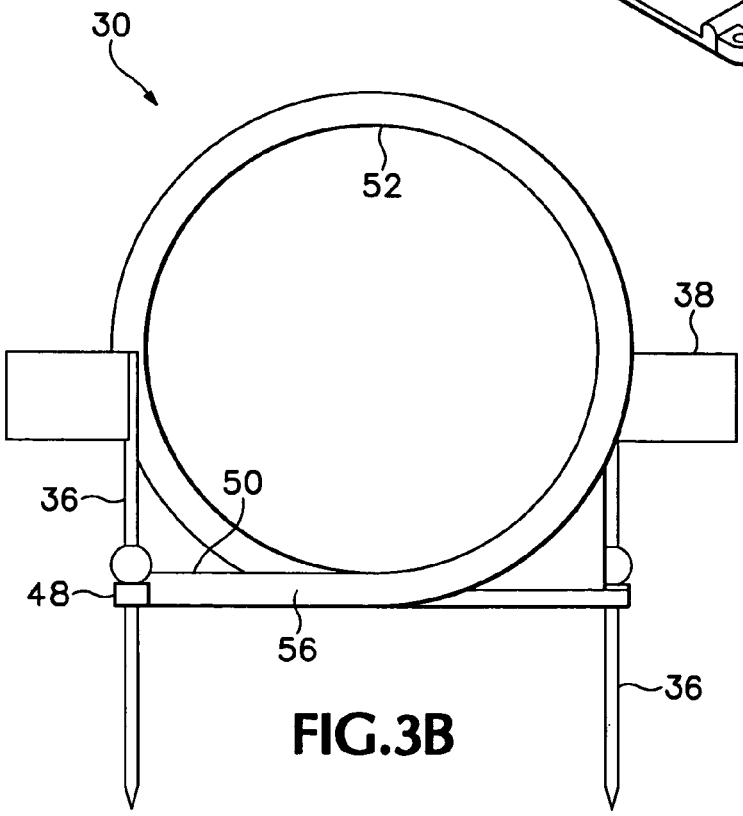
FIG. 3B is a side elevation view of the obstacle of FIG. 3A.

Referring to FIGS. 3A and 3B, a helical loop obstacle 30 is shown. The illustrated helical loop 30 has a substantially horizontal entry portion 50, a loop portion 52, and a substantially horizontal exit portion 54. The helical loop may be shaped symmetrically such that the entry portion 50 and exit portion 54 are interchangeable i.e., either side may be used for entry of the ball 22. Sidewalls 56 are positioned to act as guides for keeping a ball 22 within the helical loop 30 as the ball rolls into the entry portion 50, around and through the loop portion 52, and out from the exit portion 54. The sidewalls 56 in FIGS. 3A and 3B may be shaped differently than shown. For example they may be different size than shown or non-symmetric from one another. Another option would be to have "full" sidewalls, i.e., the sidewalls 56 would fully enclose the helical loop to become a helical tunnel. This would prevent the ball 22 from exiting the loop 30 if it were struck too hard.

Similar to the ramp 28 of FIG. 2A, the helical loop 30 may be secured to the playing field 20 by stakes 36.

Figure 4A:
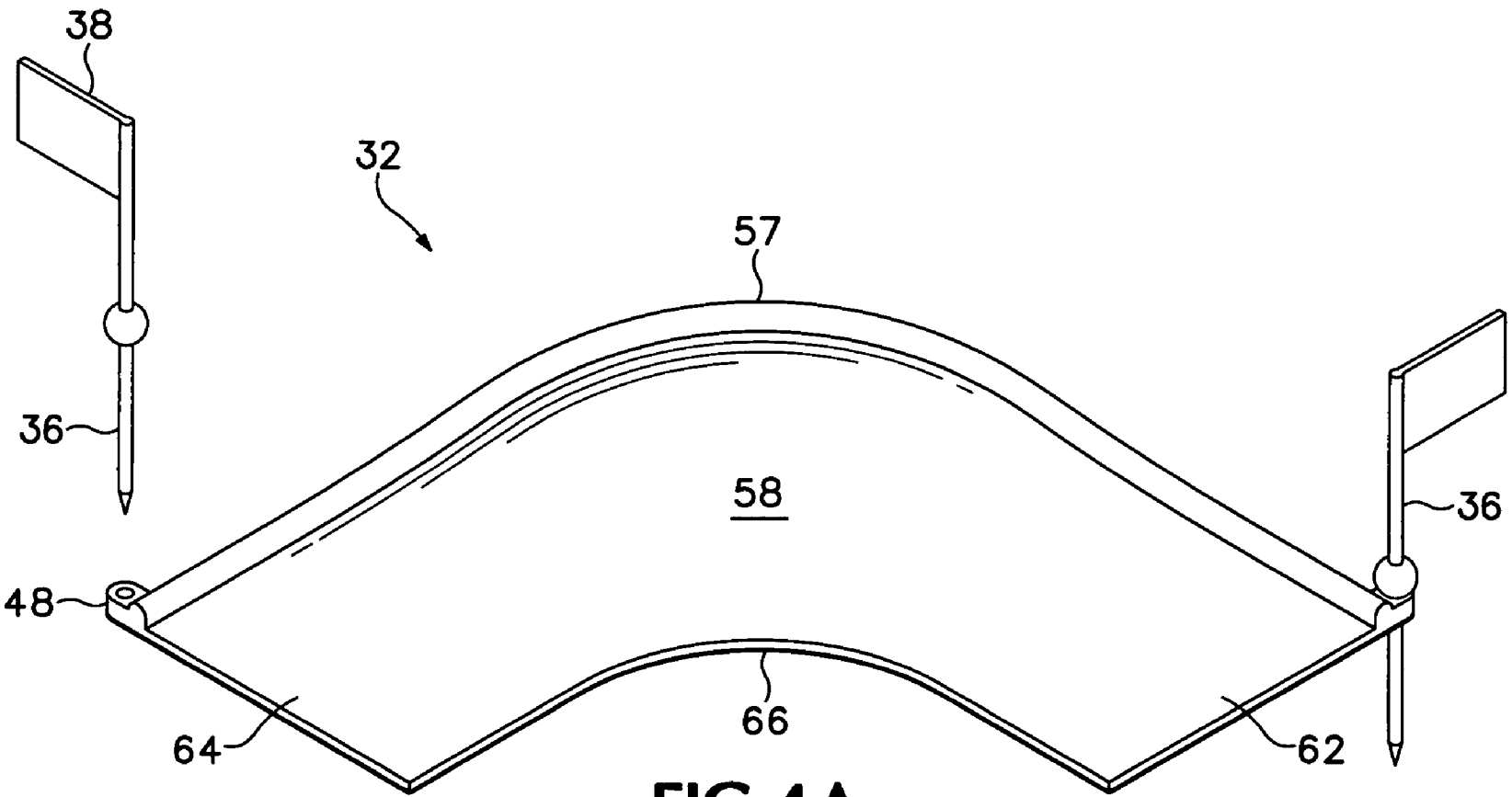
FIG. 4A is an isometric view of a corner obstacle according to yet another embodiment of the invention.
Figure 4B:
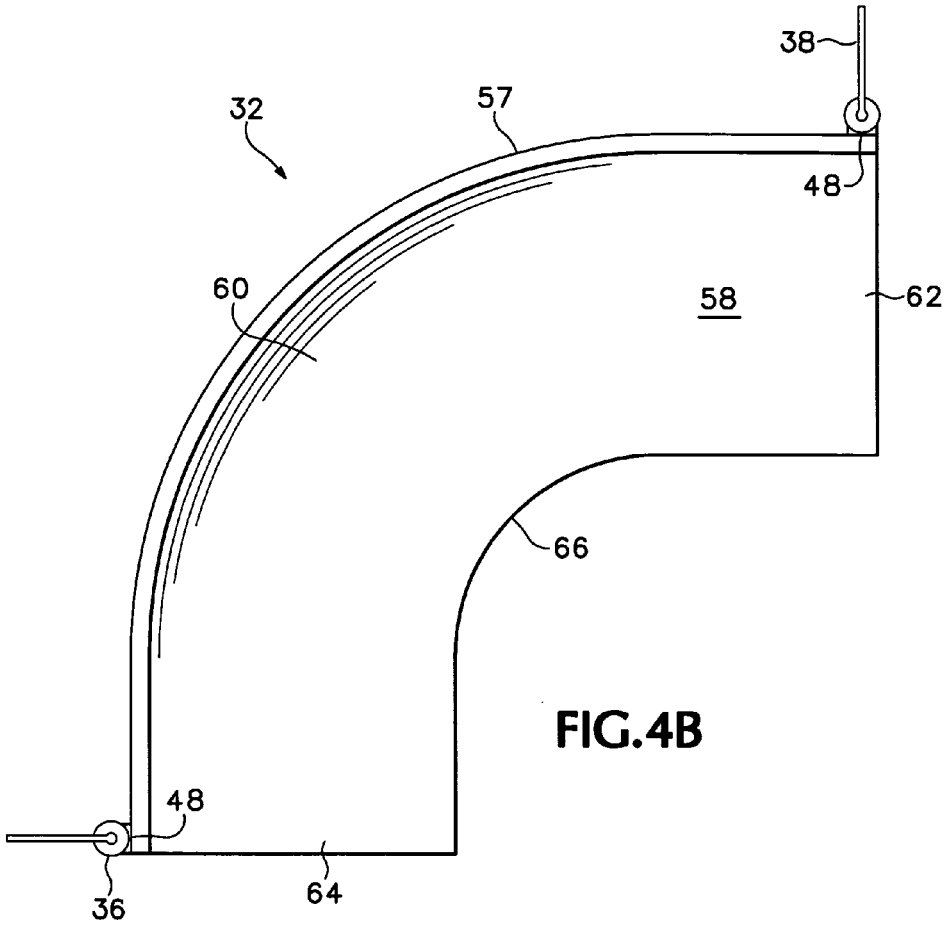
FIG. 4B is a top plan view of the obstacle of FIG. 4A.
Figure 4C:
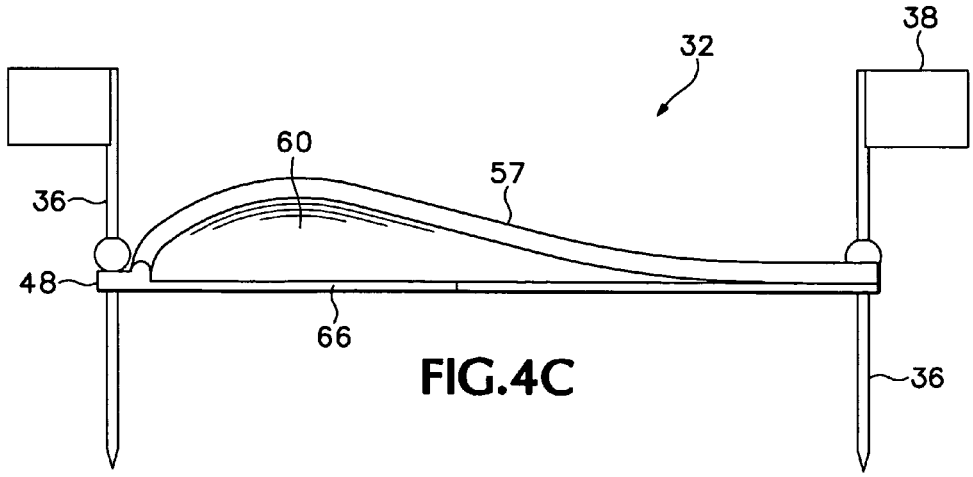
FIG. 4C is a side elevation view of the obstacle of FIG. 4A.

Referring to FIGS. 4A, 4B, and 4C, a banked corner obstacle 32 is shown. FIG. 4B is a top plan view of the banked corner 32 showing an outer sidewall 57 that follows the curved path 58 with an entry portion 62 and an exit portion 64. The banked corner 32 may be symmetrically shaped so that the entry portion 62 and the exit portion 64 are interchangeable. As a ball 22 enters the curved path 58, if the ball is struck hard enough, the ball eventually meets outer sidewall 57, which forces the ball 22 to change forward direction toward the exit portion 64. FIGS. 4A, 4B, and 4C illustrate a 90° turn, but other angles of turn may be used including either sharper turns (>90°) or shallower turns (<90°). Additionally, multiple turns can be included, for example two banked corners 32 could be placed end-to-end to create an "S" curve.

The sidewall 57 may be larger than it appears in FIGS. 4A–4C, which are only exemplary. For example, the banked corner 32 could have sidewalls 57 that are so large that the banked corner is actually a curved tunnel. In other embodiments, the sidewall 57 may be sized according to the height of a croquet ball—for instance between 10% and 100% of the height of a standard ball, although even higher or lower walls would be possible. Smaller percentages would require the player to strike the ball more softly, otherwise the struck ball would travel over the sidewall 57, and off the ramp 32.

FIGS. 4A and 4C show the banked portion 60 of the banked corner 32. In these figures, the outer region of the curved path 58 smoothly rises to a peak elevation that is higher in elevation than the entry and exit portions 62 and 64, although other elevations are possible. The inner edge 66 of the curved path 58 remains approximately at the same elevation as the entry and exit portions 62 and 64. In another embodiment, the exit portion 64 is higher than the entry portion 62, thus the corner becomes a one-way corner, because the elevated exit portion 64 would prevent entry of a struck ball 22.

Similar to the ramp 28 of FIG. 2A, the banked corner 32 may be secured to the playing field 20 by stakes 36.

Figure 5A:
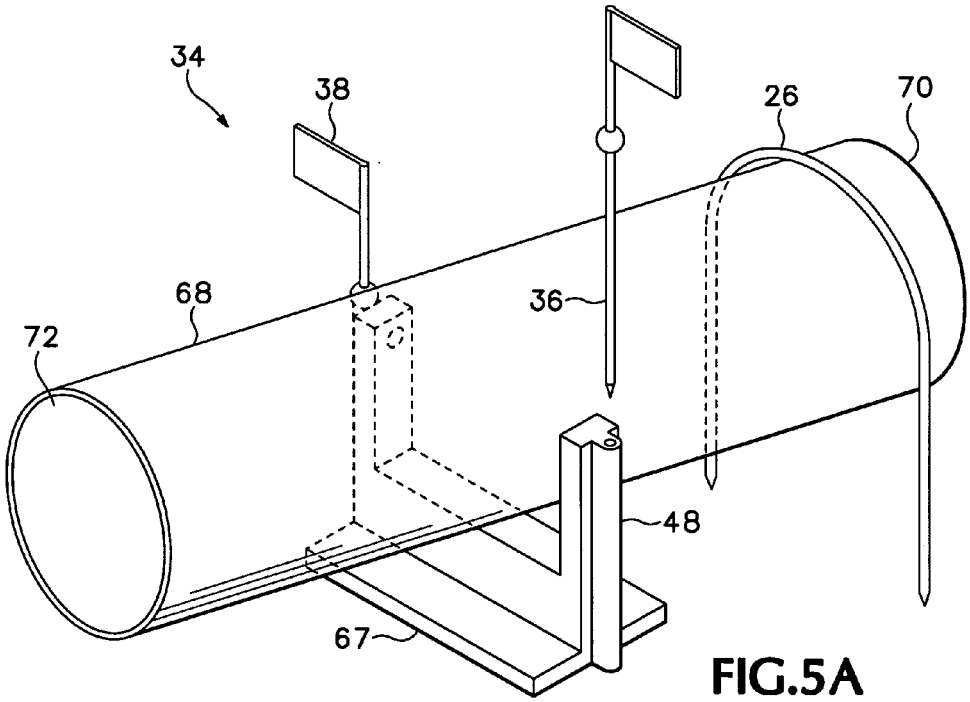
FIG. 5A is an isometric view of an inclined tunnel obstacle according to an embodiment of the invention.
Figure 5B:
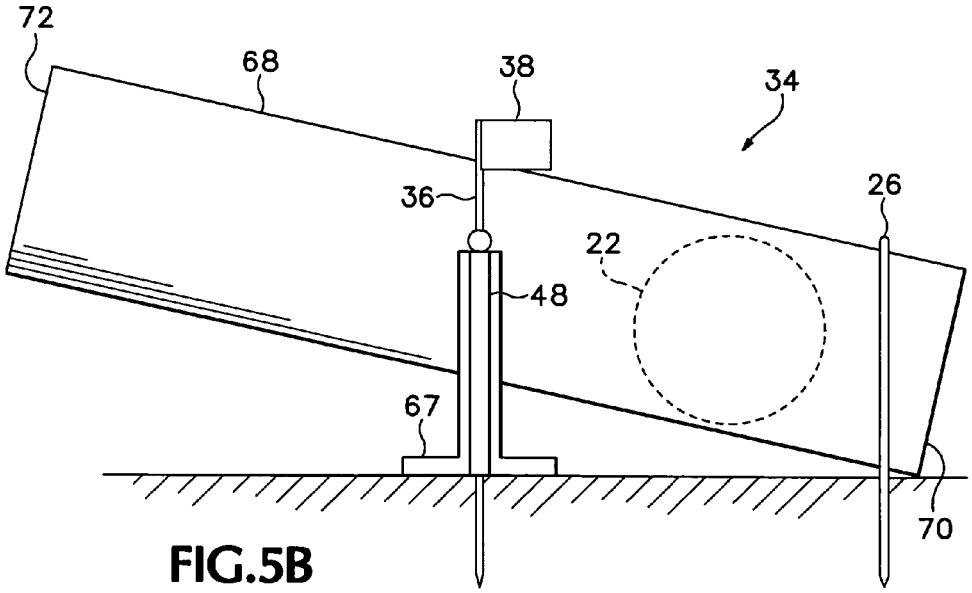
FIG. 5B is a side elevation view of the obstacle of FIG. 5A.

Referring to FIGS. 5A and 5B, a vertically inclined pipe obstacle 34 is shown. The illustrated obstacle 34 includes a base 67 and a vertically inclined pipe 68 having an entry end 70 and an exit end 72. Preferably, the pipe 68 has a diameter sized to receive and allow relatively easy passage of a croquet ball 22 therethrough, although different sizes and shapes are possible. For instance, the pipe may have an oval shape, with the major axis being either horizontal to the playing surface 20 or being vertically aligned therewith. Additionally, the opening 70 of the pipe obstacle 34 may be flanged or splayed to accommodate easier entry of a struck ball 22. Further, the top of the opening 72 may be cut away, which would allow easier entry of the ball to the pipe obstacle 34.

The pipe 68 is vertically inclined by its connection to the base 67. The entry end 70 is positioned with an elevation such that the entry end 70 is adjacent to the playing field, thereby allowing a struck ball 22 to roll into the pipe 68. The pipe 68 may be secured to the playing field 20 by a stake 36 (not shown) or by a wicket 26. The exit end 72 is positioned at an elevation higher than the entry end 70, such that a player must strike a ball 22 with the mallet 24 with enough force to propel the ball up the incline and out of the exit end 72.

The base 67 may be placed near one end of the pipe 68, or could be placed near the middle of the pipe 68. If the base 67 is placed near the middle of the pipe, a wicket 26 or stakes 36 may be used to hold the entry end 70 of the inclined pipe 68 adjacent to the ground. In another embodiment, the pipe 68 is allowed to "teeter-totter" on the base 67, such that, in a first position, the ball 22 enters the entry end 70 of the pipe 68 and, after the ball passes through the mid-section of the pipe 68, the weight of the ball 22 causes the pipe to "teeter-totter" over. Thus, the exit end 72 drops to become adjacent to the playing field 20 while simultaneously raising the entry end 70. Therefore, for the next play, the exit end 72 is now the entry end 70.

As the case in all of the obstacles of embodiments of the invention, the entry ends of the obstacles may be wider than the exit ends, thus facilitating a ball to enter the obstacle. When obstacles can be used in either direction, both of the ends may be wider than the middle portions of the obstacle for the same benefit.

As described above with reference to the ramp obstacle 28, all of the obstacles described above can be affixed to the playing field 20 by stakes 36 and appropriate eyelets 48, or by other methods. Similarly described above with reference to the ramp 28, any or all of the obstacles 28, 30, 32, and 34 may be made from any suitable material, such as plastic, molded plastic, metal, wood, wire, or any combination thereof.

Flags 38 could be useful in embodiments of the invention. In some embodiments, a flag 38 can be an extension of and formed as an upper portion of a stake 36, as illustrated in FIG. 2A, for instance. The flags 38 could be used to illustrate a number or other instruction. For example, a flag 38 could include a number to indicate the order in which to complete the obstacles on the field 20. Or, the flag 38 could indicate a color whereby a ball having the same color as indicated on the flag must complete the obstacle before any other ball can legally complete the obstacle. These colored flags 38 could be randomly assigned when a game begins, so that each colored ball must pass through "their" color assigned obstacle before any other ball could pass that obstacle. Further, each color would need to pass "their" obstacle (same color flag as their ball) first, before moving to any other obstacle.

The flags 38 could be made of plastic having indicia permanently formed thereon, or the flags could be made so as to receive indicia later placed thereon, such as by a sticker. Of course the flags 38 need not be flag-shaped at all, and could rather be shaped as numbers or letters themselves. For instance, the flags could be shaped to form numbers 1, 2, 3, etc, or could be made from different colors. Alternatively, the flags 48 could be letters or combinations of letters to indicate color. For instance, "R" could stand for red, while "BK" for black and BU" for blue.

Figure 6:
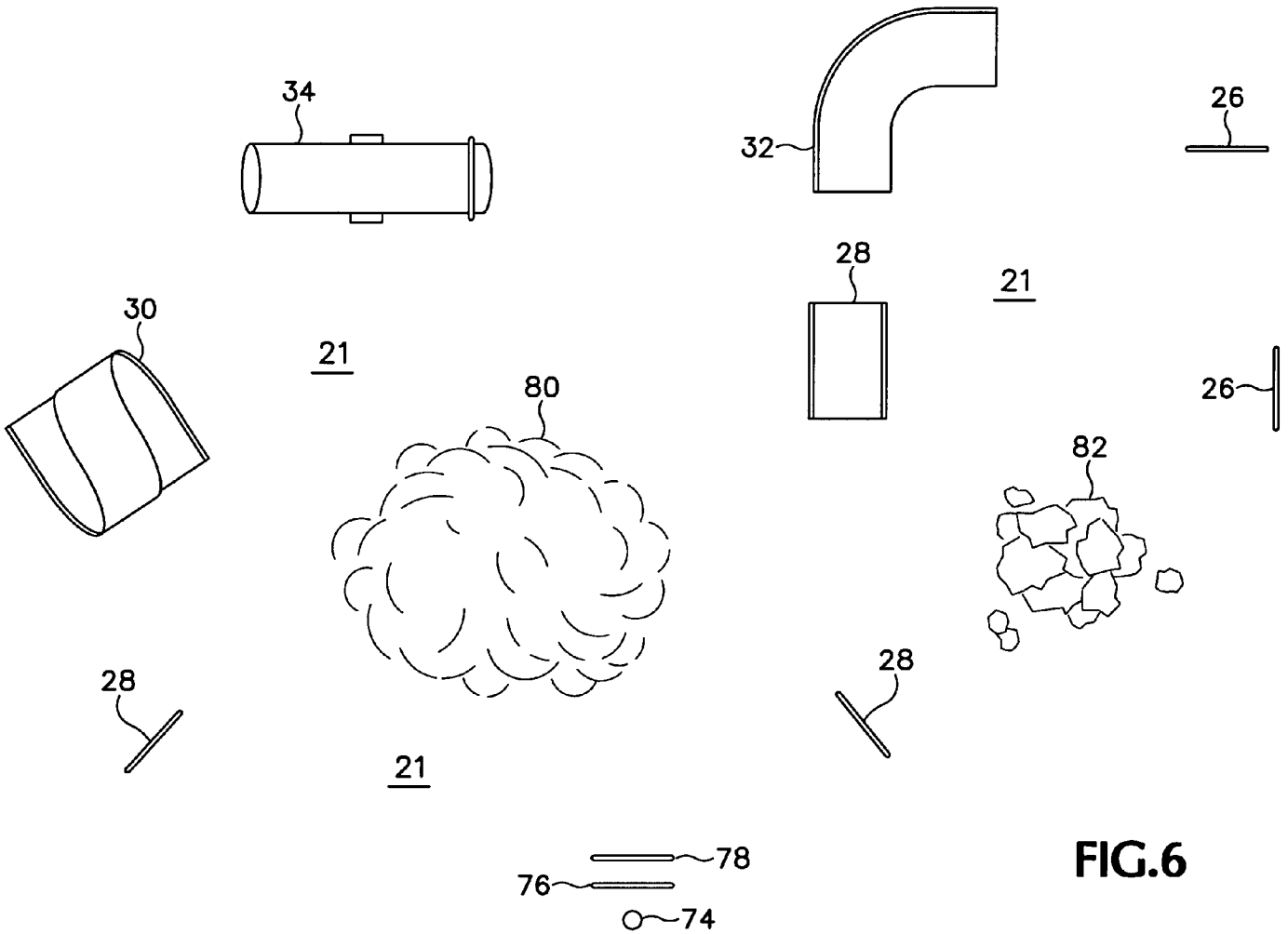
FIG. 6 is a top view of an example layout of a croquet playing field according to embodiments of the invention.

Referring to FIG. 6, an example croquet playing field 21 is illustrated. The playing field 21 includes a starting stake 74. Near the starting stake 74 is a wicket 76 and a second wicket 78. The wickets 76, 78 may be approximately 6 inches from one another and from the starting stake 74, for example. In this manner, a ball 22 can be struck by a player to roll in a relatively straight path from the starting stake 74 through both wickets 76 and 78. The playing field 21 includes remaining wickets 26 and obstacles interspersed throughout the playing field 21. The obstacles in FIG. 6 include a ramp 28, a helical loop 30, a banked corner 32, and a vertically inclined pipe 34. FIG. 6 shows one example of how the remaining wickets and obstacles can be interspersed throughout a playing field 20. Players are encouraged to be creative in positioning the wickets or obstacles by incorporating naturally formed obstacles such as tree 80 or rocks 82 in a course on the playing field. The placement of wickets and obstacle can be changed from game to game.

Sample Rules of Play

Although the obstacles according to embodiments of the invention can be used in a variety of different ways, an example set of rules of play is included below.

1. The starting stake, like traditional croquet starting stakes, may include a series of differently colored horizontal stripes corresponding to the colors of the balls. The order of colors on the stake dictates the order of gameplay. If more than one croquet set is used, players can use one set of striped balls and one set of solidly colored balls with either the solid or striped ball going first.

2. At the beginning of the game, the ball is placed on the line between the starting stake and the first wicket.

3. The ball can be struck with the face or side of the mallet, but it must be struck and not "pushed."

4. Every player has a right to an additional stroke after driving his or her ball through a wicket, successfully completing an obstacle, or striking an opponent's ball (croquet). However a player may not repeat striking the same opponent's ball for an additional stroke without first going through a wicket or completing an obstacle.

5. A player driving his or her ball through both first and second wickets is entitled to two additional strokes, (one for each wicket).

6. A stroke counts even if the ball moves only slightly.

7. A player may, if he or she completely misses the ball while attempting to strike the ball, strike again.

8. If a player's ball strikes an opponent's ball and both go through a wicket or complete an obstacle, the player may play through, but the croqueted ball must return and pass the obstacle under his or her own power.

9. If a ball is driven from the playing field, it must be put back onto the field one mallet's head length from the edge; however the player may choose to bring it back onto the field at the beginning of his next turn, rather than immediately after the ball leaves the field.

10. If the player chooses to remain out of bounds until his next turn, another player may still hit (croquet) off the ball in the out of bounds area, and the ball may be hit by POISON (described below) and taken out of the game.

11. A ball has successfully passed the wicket if it is more than half way through.

12. After completing all of the wickets and obstacles, the player returns and hits the starting post with his ball. The player then immediately places his or her ball one mallet's head length from the post in any direction and awaits a next turn. The player is now POISON, which gives the player special powers.

13. Any POISON ball that hits a wicket or obstacle is "dead" and out of the game.

14. Any NON-POISON ball that is struck by a POISON ball is dead and out of the game.

15. If a POISON ball is struck by another POISON ball, the sitting ball that is struck is dead and out of the game.

16. A POISON ball does not get an additional stroke after hitting another ball.

17. The winner of the game is the last ball remaining on the field after all others are taken out of the game by POISON.

18. Alliances may be made between players, however there is no penalty for breaking the alliance.

Several variations in the above rules may be observed. For instance, each obstacle may be "assigned" to a specific colored ball that must complete or negotiate that obstacle before the obstacle is "open" to be played by other players. Or, any obstacle is open to all players, but each player has a specifically assigned obstacle that must be completed before they may complete any other obstacle. The assignments of obstacles to players may be made by the numbered or colored flags, as described above.

Those skilled in the art recognize that the inventive yard game described herein can be implemented in many different variations. Therefore, although various embodiments are specifically illustrated and described herein, it will be appreciated that modifications and variations of the present invention are covered by the above teachings and within the purview of the appending claims without departing from the spirit and intended scope of the invention.

What is claimed is:

1. A game adapted to be played on a grass surface, the game comprising:

one or more portable solid-surface game obstacles structured to cause a game ball to change vertical position relative to a playing field to which the obstacles are attached after said ball has been struck;

wherein at least one of the game obstacles is structured to cause a ball to travel in a helical loop and is further structured to be temporarily affixed to the playing field by removable securing stakes;

wherein the one or more obstacles each include receivers, the securing stakes each having a lower portion structured to pass through one of the receivers and each having an upper portion that is separated from the lower portion by a projection structured to mechanically interfere with an entrance of one of the receivers; and wherein the upper portion is approximately the same length as the lower portion and the projection includes a diameter larger than a radial diameter of the upper or lower portions.

2. The game of claim 1 wherein the upper portion includes a flag or other obstacle designator.

3. A portable helical loop yard game obstacle, comprising:

a main surface having a generally helical curved shape;

an entrance of the main surface lying on top of a playing surface;

an attaching device attaching the entrance to the playing surface, wherein the obstacle is removably positional in different orientations on the playing surface;

at least one receiver coupled to the entrance of the obstacle and structured to accept the attaching device therethrough, wherein the attaching device includes a lower portion structured to pass through an opening of the receiver and an upper portion that is separated from the lower portion by a projection structured to mechanically interfere with the opening;

wherein the projection includes a diameter larger than the opening; and wherein the upper portion is approximately the same length as the lower portion.

4. The obstacle of claim 3 including a flag or other obstacle designator connected to the upper portion.

5. A croquet obstacle set, comprising:

a first obstacle structured to be temporarily secured to a playing surface and structured to ramp a croquet ball that enters an entry portion of the first obstacle;

a second obstacle structured to be temporarily secured to a playing surface and structured to cause a croquet ball that enters an entry portion of the second obstacle to travel in a helical loop;

a third obstacle structured to be temporarily secured to a playing surface and structured to cause a croquet ball to travel around a banked curve structure; and a fourth obstacle structured to be temporarily secured to a playing surface and structured to ramp through an inclined tunnel a croquet ball that enters an entry portion of the fourth obstacle.

6. The croquet set of claim 5 wherein at least one of the obstacles structured to be temporarily securable to a playing surface includes a securing device coupled to the at least one obstacle.

7. The croquet set of claim 6 wherein the securing device is a receiver through which a stake can pass.

8. A game adapted to be played on a grass surface, the game comprising:

one or more portable solid-surface game obstacles structured to cause a game ball to change vertical position relative to a playing field to which the obstacles are attached after said ball has been struck, wherein at least one of the game obstacles is structured to cause a ball to travel in a helical loop and is further structured to be temporarily affixed to the playing field by removable securing stakes; and wherein at least one of the game obstacles is structured to be temporarily secured to a playing surface and structured to cause a croquet ball to travel around a banked curve structure.

9. A croquet obstacle set, comprising:

a first obstacle structured to be temporarily secured to a playing surface and structured to ramp a croquet ball that enters an entry portion of the first obstacle; and a second obstacle structured to be temporarily secured to a playing surface and structured to cause a croquet ball that enters an entry portion of the second obstacle to travel in a helical loop; and a third obstacle structured to be temporarily secured to a playing surface and structured to cause a croquet ball to travel around a banked curve structure.

10. A croquet obstacle set, comprising:

a first obstacle structured to be temporarily secured to a playing surface and structured to cause a croquet ball to travel around a banked curve structure; and a second obstacle structured to be temporarily secured to a playing surface and structured to cause a croquet ball that enters an entry portion of the second obstacle to travel in a helical loop.

11. The croquet obstacle set of claim 10 including a third obstacle structured to be temporarily secured to a playing surface and structured to ramp through an inclined tunnel a croquet ball that enters an entry portion of the third obstacle.

* * * * *